US010626880B2

(12) United States Patent
Obuchi et al.

(10) Patent No.: US 10,626,880 B2
(45) Date of Patent: Apr. 21, 2020

(54) IMPELLER ASSEMBLY FOR CENTRIFUGAL PUMPS

(71) Applicant: Ebara Corporation, Tokyo (JP)

(72) Inventors: Masashi Obuchi, Tokyo (JP); So Kuroiwa, Tokyo (JP); Dai Sakihama, Tokyo (JP); Renato Groppo, Cles (IT); Fabio Balbo, Cles (IT); Mariano Matteazzi, Cles (IT); Lucio Cardillo, Rome (IT); Alessandro Corsini, Rome (IT); Giovanni Delibra, Rome (IT); Franco Rispoli, Rome (IT)

(73) Assignee: Ebara Corporation, Tokyo (JP)

( * ) Notice: Subject to any disclaimer, the term of this patent is extended or adjusted under 35 U.S.C. 154(b) by 208 days.

(21) Appl. No.: 15/517,056

(22) PCT Filed: Oct. 8, 2015

(86) PCT No.: PCT/JP2015/079244
§ 371 (c)(1),
(2) Date: Apr. 5, 2017

(87) PCT Pub. No.: WO2016/060221
PCT Pub. Date: Apr. 21, 2016

(65) Prior Publication Data

US 2017/0260992 A1 Sep. 14, 2017

(30) Foreign Application Priority Data

Oct. 14, 2014 (IT) ..... VI2014A0271

(51) Int. Cl.
*F04D 29/22* (2006.01)
*F04D 1/06* (2006.01)

(52) U.S. Cl.
CPC ..... *F04D 29/2266* (2013.01); *F04D 1/06* (2013.01); *F04D 29/2222* (2013.01)

(58) Field of Classification Search
CPC ..... F04D 29/2266
See application file for complete search history.

(56) References Cited

U.S. PATENT DOCUMENTS 4,986,736 A 1/1991 Kajiwara et al.
5,595,473 A 1/1997 Nagaoka et al.
(Continued)

FOREIGN PATENT DOCUMENTS

CN 1111727 A 11/1995
CN 1209194 A 2/1999
(Continued)

OTHER PUBLICATIONS

English machine translation of JP S49-85602 (Year: 1972).*
(Continued)

*Primary Examiner* — Igor Kershteyn
*Assistant Examiner* — Brian O Peters
(74) *Attorney, Agent, or Firm* — Leydig, Voit & Mayer, Ltd.

(57) ABSTRACT

An impeller assembly for centrifugal pumps has two disk members that have different diameters, are arranged coaxially to a rotation axis and face each other so as to form an interspace; blades are radially arranged in the interspace; the two disk members are also centrally provided with a fastening means for fastening to a transmission shaft, which rotates about the rotation axis. The particularity of the present invention resides in having contoured vanes that protrude radially from the peripheral region of the disk member that has the smallest diameter and are arranged substantially at the blades.

1 Claim, 9 Drawing Sheets

(56) References Cited

U.S. PATENT DOCUMENTS 5,605,444 A * 2/1997 Paton ..... F04D 29/2277 416/183
6,481,961 B1 11/2002 Pai

FOREIGN PATENT DOCUMENTS

| | | | |
|---|---|---|---|
| CN | 101086262 | A | 12/2007 |
| CN | 201794792 | U | 4/2011 |
| CN | 103122871 | A | 5/2013 |
| CN | 103790832 | A | 5/2014 |
| FR | 2837880 | A1 | 10/2003 |
| JP | S49-85602 | U | 7/1974 |
| JP | S52-54802 | Y2 | 12/1977 |
| JP | S54-93802 | U | 7/1979 |
| JP | S64-12096 | A | 1/1989 |
| JP | 2009-167990 | A | 7/2009 |
| RU | 2186251 | C2 | 7/2002 |
| RU | 2268398 | C1 | 1/2006 |
| SU | 754117 | A1 | 8/1980 |
| SU | 1105696 | A1 | 7/1984 |

OTHER PUBLICATIONS

European Patent Office, Extended European Search Report in European Application No. 15850633.7 (dated May 15, 2018).
Chinese Patent Office, Notification of the First Office Action in Chinese Patent Application No. 201580055402.4 (dated Aug. 3, 2018).
Japan Patent Office, International Search Report in International Application No. PCT-JP2015-079244 (dated Dec. 28, 2015).
China Patent Office, Office Action in Chinese Patent Application No. 201580055402.4 (dated Jun. 15, 2019).
Russian Patent Office, Office Action in Russian Patent Application No. 2017115770 (dated Apr. 2, 2019).

* cited by examiner

IMPELLER ASSEMBLY FOR CENTRIFUGAL PUMPS

TECHNICAL FIELD

The present invention relates to an impeller assembly, particularly for centrifugal pumps, of the type with one or more stages.

BACKGROUND ART

As is known, the impellers of centrifugal pumps generally have pairs of shaped disk bodies facing each other so as to form an interspace wherein a set of blades that connect the two disks are arranged.

Also, a hub, or an equivalent coupling device, is provided centrally with respect to each impeller and allows to fasten the impeller to a transmission shaft that is turned by a motor means.

SUMMARY OF THE INVENTION

Technical Problem

Although the above described prior art impellers are widely used, they have drawbacks; among those drawbacks, perhaps the most important is due to the generation of axial thrusts.

The impeller of a centrifugal pump is in fact subjected to different pressures that act on its two faces: a pressure lower than atmospheric pressure generally acts on the intake side, while a pressure substantially equal to the delivery pressure acts on the opposite face.

This produces an axial thrust that may become considerable, such as to create great losses in terms of efficiency and overloads that damage the bearings of the motor.

Those problems are manifestly increased in the case of multistage pumps.

In an attempt to solve the problems linked to the generation of axial thrusts, some manufacturers of multistage pumps key half of the impellers in the opposite direction with respect to the remaining ones.

However, such solution creates considerable difficulties when forming the internal passage channels.

Other manufacturers instead provide holes on the disk body on the delivery side, however, the holes reduce the overall efficiency of the impellers.

The aim of the invention is to solve the problems described above, providing an impeller assembly, particularly for centrifugal pumps, that allows to reduce the axial thrusts while ensuring maximum efficiency.

Within the scope of this aim, a particular object of the invention is to provide an impeller assembly that allows to solve the problems linked to the traction that is generally generated on the transmission shaft.

Another object of the invention is to provide an impeller assembly that allows to preserve the bearings of the motor.

Another object of the invention is to provide an impeller assembly that can be manufactured with a low number of components and is therefore advantageous also from a purely economic standpoint.

Solution to the Problem

This aim, these objects and others that will become better apparent hereinafter are achieved by an impeller assembly, for centrifugal pumps, comprising a smaller diameter disk member and a larger diameter disk member arranged coaxially to a rotation axis and facing each other so as to form an interspace; said disk members being connected by blades arranged radially within said interspace and being centrally provided with fastening means for fastening to a transmission shaft, which rotates about said rotation axis; said impeller assembly being characterized in that it comprises contoured vanes that protrude radially from the peripheral region of said smaller diameter disk member; said contoured vanes being arranged substantially at said blades.

The present invention also relates to a centrifugal pump comprising a substantially hollow body that accommodates at least one impeller assembly that is fastened to a transmission shaft, which rotates about a rotation axis; said transmission shaft being rotated by a motor means; said impeller assembly comprising two disk members having different diameters, which are arranged coaxially to said rotation axis and face each other so as to form an interspace; said disk members being connected by blades arranged radially within said interspace and being provided centrally with a fastening means for fastening to said transmission shaft; said impeller assembly being characterized in that it comprises contoured vanes that protrude radially from the peripheral region of the disk member having a smallest diameter; said contoured vanes being arranged substantially at said blades and being configured to reduce axial thrusts.

BRIEF DESCRIPTION OF THE DRAWINGS

Further characteristics and advantages will become better apparent from the description of preferred but not exclusive embodiments of an impeller assembly according to the invention, illustrated by way of non-limiting example in the accompanying drawings, wherein.

DESCRIPTION OF THE EMBODIMENTS

Figure 1:
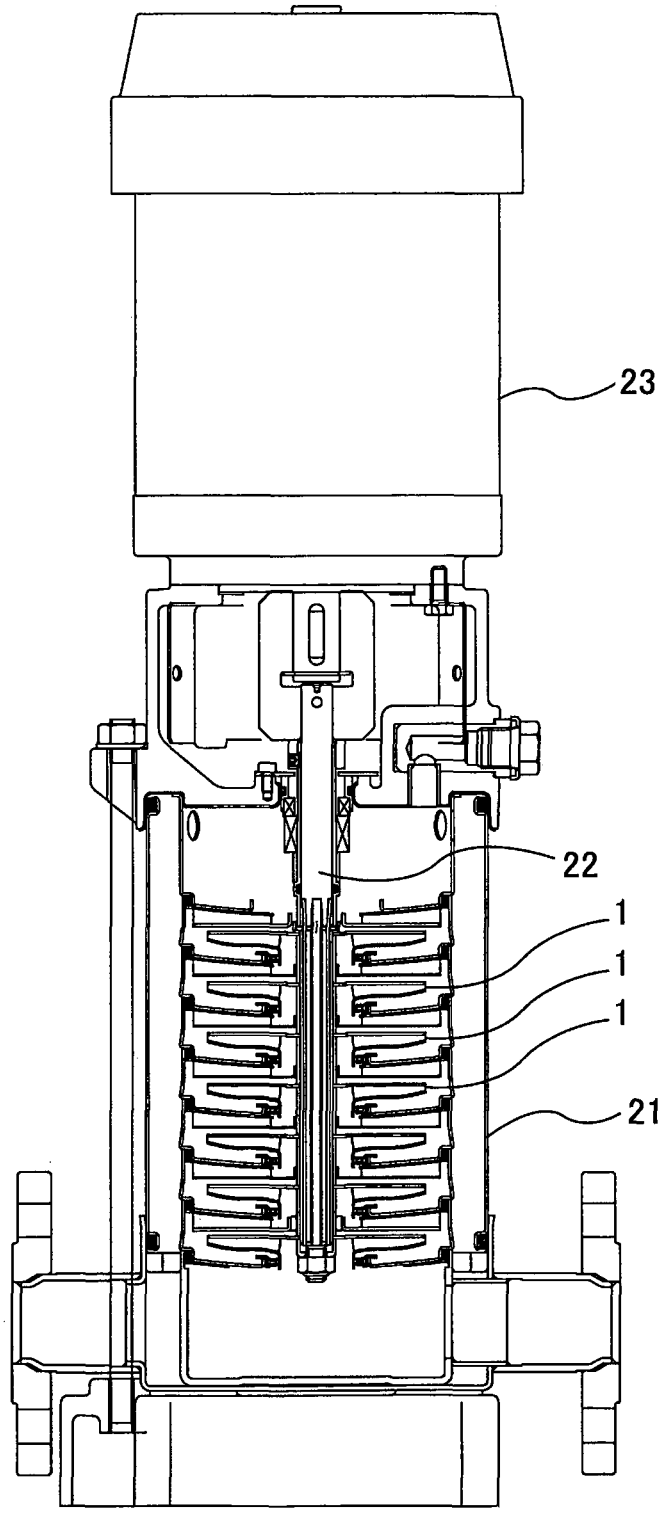
FIG. 1 is a sectional view of a multistage centrifugal pump.
Figure 2:
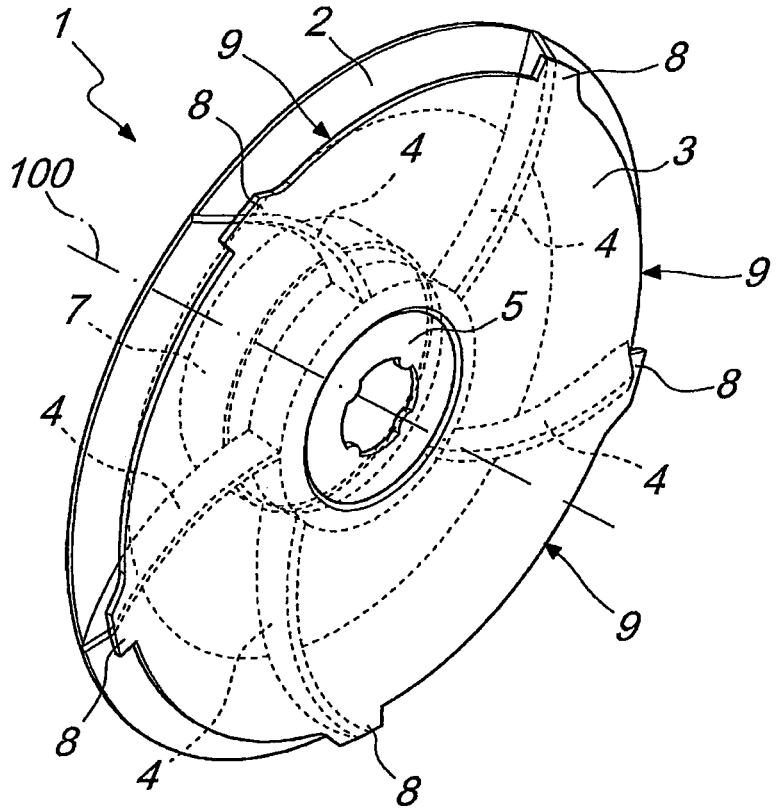
FIG. 2 is a perspective view of an impeller assembly according to the invention.
Figure 3:
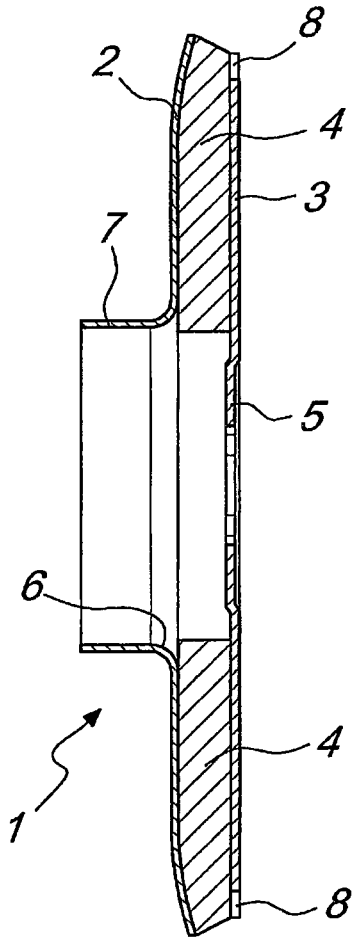
FIG. 3 is a sectional side view of the impeller assembly according to the invention.
Figure 4:
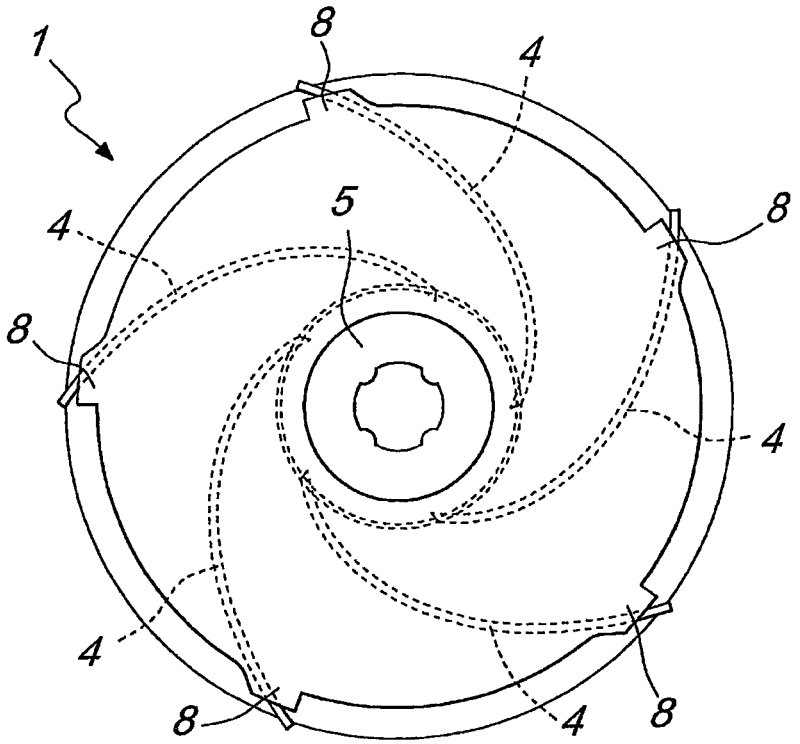
FIG. 4 is a front view of the impeller assembly according to the invention.
Figure 5:
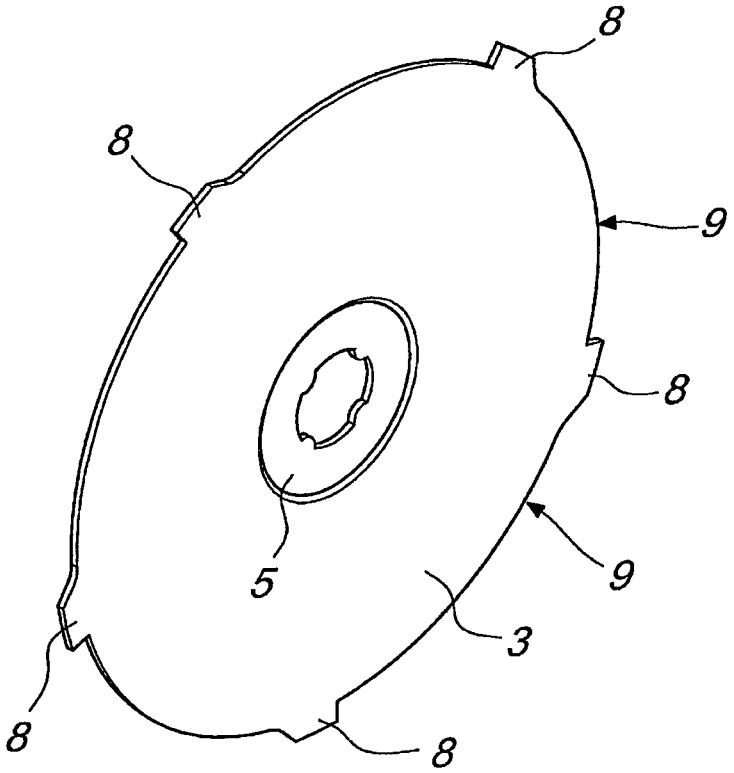
FIG. 5 is a perspective view of a component of an impeller assembly according to the invention.
Figure 6:
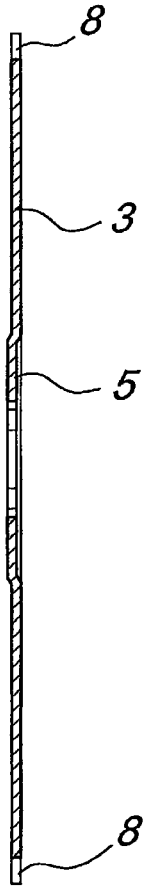
FIG. 6 is a sectional side view of the component of the preceding figure.
Figure 7:
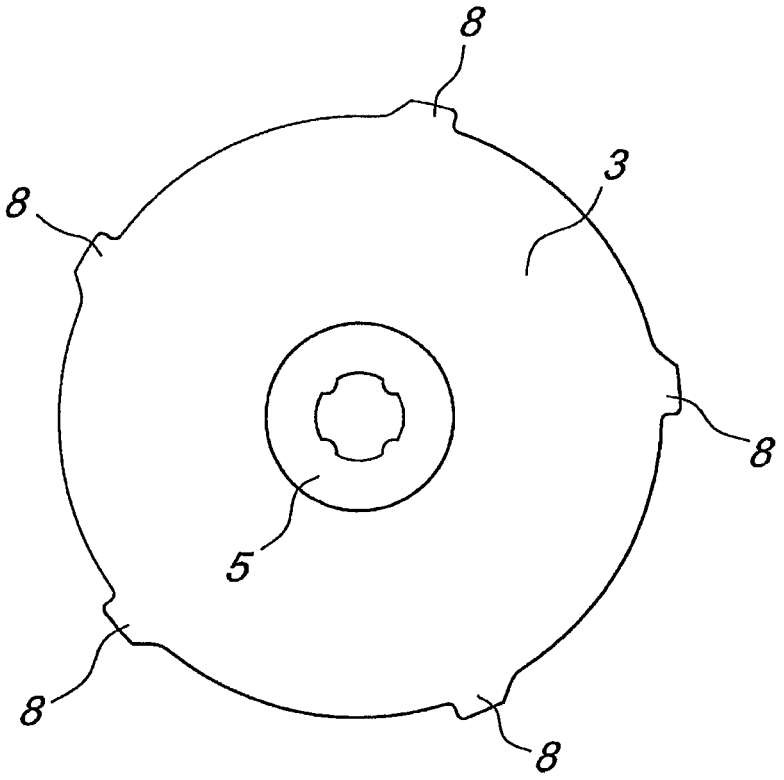
FIG. 7 is a front view of the component of FIGS. 5 and 6.

With reference to FIGS. 1 to 7, an impeller assembly, for centrifugal pumps, is globally designated by the reference numeral 1.

The example illustrated here refers to the case in which the impeller assembly 1 relates to a multistage centrifugal pump; however, it is evident to the person skilled in the art, that the impeller assembly according to the present invention may also be mounted on pumps of a different type.

The multistage centrifugal pump, which is shown in FIG. 1, is constituted by a substantially hollow body 21 that accommodates a set of impeller assemblies 1 provided according to the present invention; the impeller assemblies 1 are coaxially fastened to a transmission shaft 22 that is turned by a motor means 23.

The impeller assembly 1 comprises a larger diameter disk member 2, related to the intake, and a smaller diameter disk member 3, related to the delivery.

The two disk members 2 and 3 are coaxial to a rotation axis 100 and face each other so as to form a substantially cylindrical interspace.

Blades 4 are arranged in the interspace and rigidly connect the larger diameter disk member 2 to the smaller diameter disk member 3.

The blades 4 are distributed angularly around the rotation axis 100 and extend from the center toward the peripheral region of the two disk members 2 and 3, without protruding from the larger diameter disk member.

In the illustrated embodiment, for example, the blades 4 are curved so as to form diverging ducts that are arranged radially.

Advantageously, the two disk members 2 and 3 are provided with a fastening means for fastening to the transmission shaft 22, shown in FIG. 1, which can rotate about the rotation axis 100.

In the specific case, the fastening means comprises a hub 5 that is provided at the center of the smaller diameter disk member 3.

The hub 5 is conceived so that it can be mechanically associated with the transmission shaft 22.

The fastening means also has a through hole 6 that is formed centrally with respect to the larger diameter disk member 2.

The through hole 6 has a larger cross-section than the transmission shaft 22 and blends with a collar 7 that protrudes from the larger diameter disk member 2.

In practice, when the impeller assembly 1 is mounted on the transmission shaft 22, the collar 7 surrounds the shaft 22, providing an annular opening that constitutes the intake of the impeller.

According to the present invention, the impeller assembly 1 comprises contoured vanes 8, which protrude radially from the peripheral region of the smaller diameter disk member 3, substantially at the blades 4.

It should be noted that the profile of the contoured vanes 8 is conceived so as to reduce the axial thrusts.

In the embodiment shown in FIGS. 2 to 7, the contoured vanes 8 are substantially trapezoidal and extend within an annular region included between circumferences whose diameters coincide respectively with those of the two disk members 2 and 3.

The contoured vanes 8, which are distributed angularly around the rotation axis 100, are spaced by a corresponding number of arc profiles 9.

With particular reference to FIGS. 2 to 7, the arc profiles 9 substantially correspond to parts of a circumference that is concentric with respect to the rotation axis 100.

Conveniently, the peripheral end of the blades 4 is contoured so that it can blend the contoured vanes 8 with the larger diameter disk member 2.

The impeller assembly 1 may be manufactured by means of various techniques, using metallic materials such as for example steel, stainless steel, die-cast steel, cast iron, brass and the like, or other materials having the necessary technological characteristics, such as for example some technopolymers.

Figure 8:
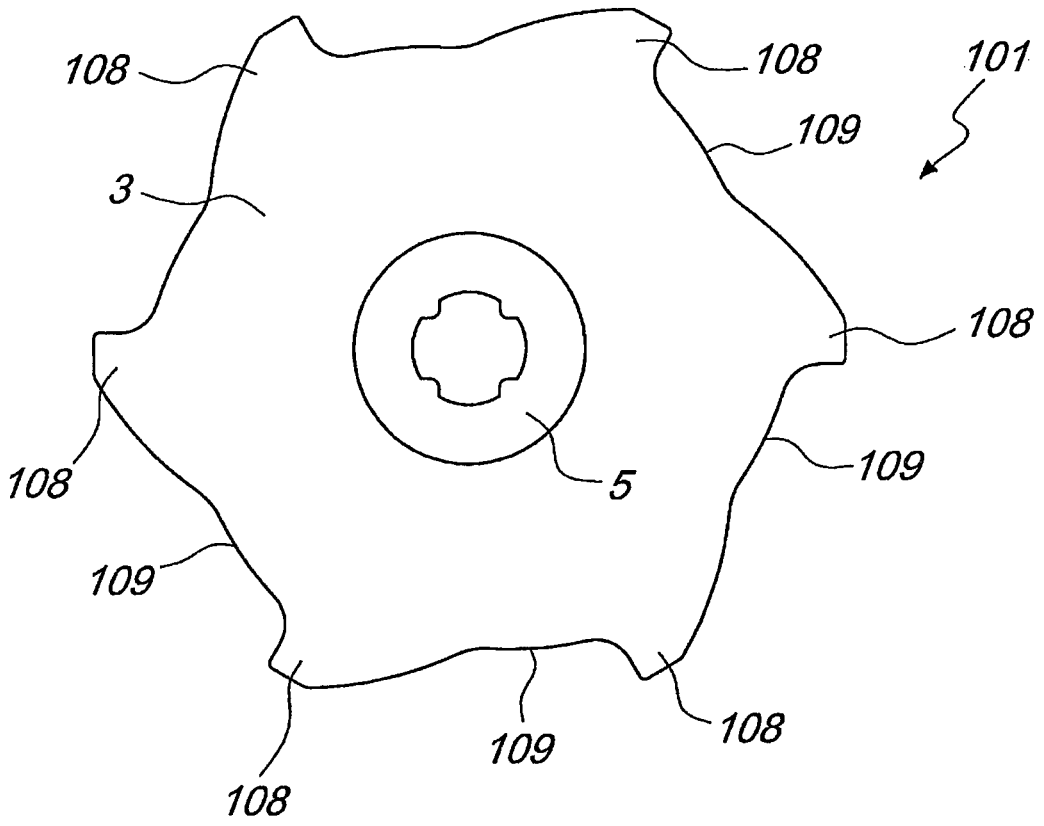
FIG. 8 is a front view of a component of an impeller assembly according to a further aspect of the invention.
Figure 9:
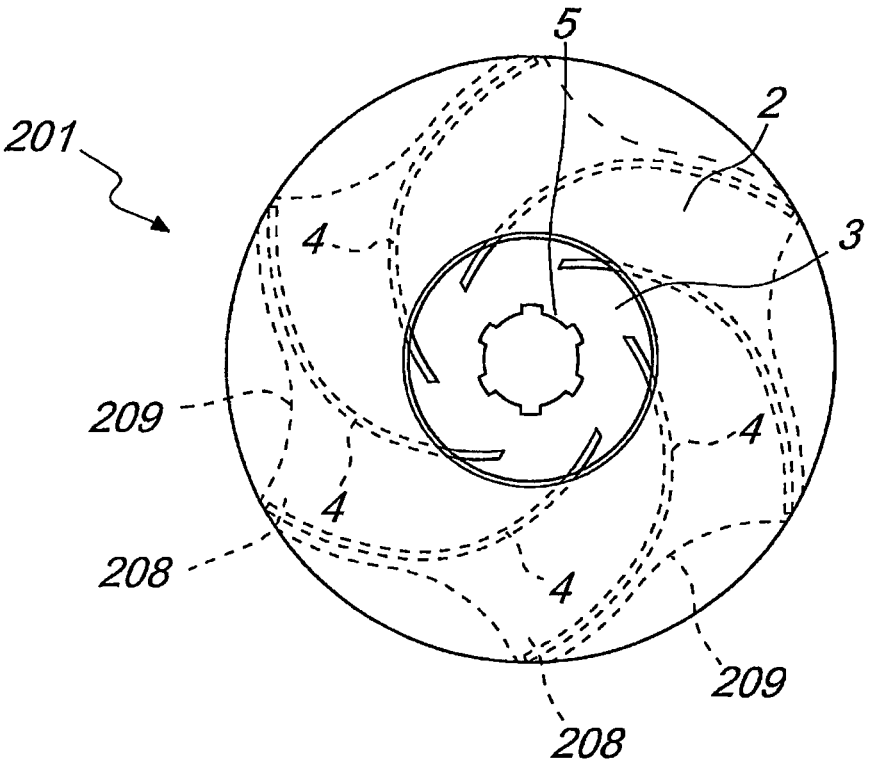
FIG. 9 is a rear view of an impeller assembly according to still a further aspect the invention.
Figure 10:
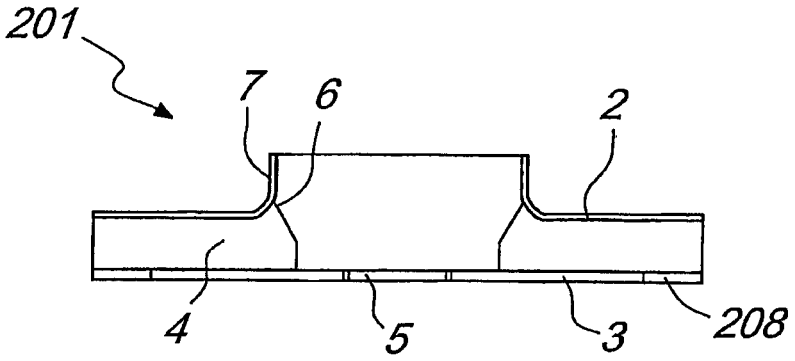
FIG. 10 is a sectional view of the impeller assembly of FIG. 9.

FIGS. 8 to 10 illustrate embodiments of the invention wherein the impeller assembly is designated respectively by the reference numerals 101 and 201, and have arc profiles, respectively 109 and 209, provided with more or less large portions with a distance that increases radially with respect to the rotation axis 100.

The shape of the arc profiles 109 and 209 in practice also conditions the shape of the contoured vanes, designated respectively by the numerals 108 and 208, which can become much more curvilinear than the preceding case, so much as to blend without discontinuities with the arc profiles 109 and 209.

In the embodiments shown in FIGS. 8 to 10, the elements that correspond to the elements already described with reference to the embodiment shown in FIGS. 2 to 7 have been designated by the same reference numerals.

The multistage centrifugal pump, shown in FIG. 1, may include a plurality of impeller assemblies 101, or may include a plurality of impeller assemblies 201, instead of the impeller assemblies 1.

As regards the operation of the impeller assembly according to the invention, experimental tests and careful analysis of the results have allowed to observe that the presence of the contoured vanes 8, 108 or 208 on the smaller diameter disk member 3 entails a better fluid-dynamics efficiency and a good head for an equal reduction of axial thrusts.

In practice it has been found that the impeller assembly, for centrifugal pumps, according to the invention, fully achieves the intended aim, considerably reducing the axial thrusts and at the same time ensuring maximum efficiency and head.

By eliminating the areas subjected to higher pressure in the smaller diameter disk member, or by forming the contoured vanes, it is in fact possible to reduce the forces that generate the axial thrust.

Also, since the contoured vanes are in practice integral parts of the smaller diameter disk member, which extend at the blades having a trapezoidal shape or the like, head and efficiency are not reduced.

The impeller assembly according to the present invention therefore solves the problems linked to the traction that is usually generated on the transmission shaft of centrifugal pumps with one or more stages.

This allows, for example, to avoid damage of the engine bearings.

In practice, the materials used, so long as they are compatible with the specific use, as well as the contingent shapes and dimensions, may be any according to the requirements and the state of the art.

The invention claimed is:

1. An impeller assembly, for centrifugal pumps, comprising a first disk member and a second disk member arranged coaxially to a rotation axis and facing each other so as to form an interspace; said first disk member having a diameter smaller than a diameter of said second disk member; said disk members being connected by blades arranged radially within said interspace and being centrally provided with respect to a transmission shaft, which rotates about said rotation axis; said impeller assembly comprising contoured vanes that protrude radially from a peripheral region of said first disk member; said contoured vanes being arranged at said blades, said contoured vanes being spaced by a corresponding number of arc profiles that correspond to arcs of a circumference; each of said arc profiles comprising at least one portion whose distance increases radially with respect to said rotation axis.

* * * * *